United States Patent [19]

Hannerstig

[11] Patent Number: 5,018,567

[45] Date of Patent: May 28, 1991

[54] METHOD FOR FORMING TIE-BACK POUFS

[75] Inventor: Christer Hannerstig, Hollviksnan, Sweden

[73] Assignee: AB A. Svensson & Co., Malmö, Sweden

[21] Appl. No.: 451,097

[22] Filed: Dec. 15, 1989

Related U.S. Application Data

[63] Continuation of Ser. No. 370,340, Jun. 22, 1989, Pat. No. 4,958,646, and a continuation-in-part of Ser. No. 114,655, Oct. 28, 1987, abandoned.

[30] Foreign Application Priority Data

Oct. 29, 1986 [DE] Fed. Rep. of Germany ..... 3636845
Oct. 12, 1987 [EP] European Pat. Off. ..... 87114878.9

[51] Int. Cl.[5] ..... A47H 13/14
[52] U.S. Cl. ..... 160/348; 160/349.2
[58] Field of Search ..... 160/348, 349.1, 349.2, 160/405; 248/251, 252, 261, 262; D6/578, 580; D8/354, 368, 369, 370, 371

[56] References Cited

U.S. PATENT DOCUMENTS

| | | | |
|---|---|---|---|
| 464,499 | 12/1891 | Grenelle | 160/349.2 X |
| 827,000 | 7/1906 | Dinsmore | 160/349.2 X |
| 851,678 | 4/1907 | Levy | 160/349.2 X |
| 1,730,979 | 10/1929 | Liebchen | 160/349.2 X |
| 1,836,018 | 12/1931 | Dover | 160/349.2 X |
| 1,980,918 | 11/1934 | Hudspeth | 160/349.2 X |
| 2,431,934 | 12/1947 | Higgins | 160/349.2 |
| 2,480,360 | 8/1949 | Doty | 248/252 |
| 2,606,733 | 8/1952 | Krajewski | 160/348 X |
| 4,284,258 | 8/1981 | Kleiman | 248/251 |

*Primary Examiner*—David M. Purol

[57] ABSTRACT

The invention relates to a method and kit for forming a decorative shape with the portion of a curtain material that extends down along the side of a window. The decorative shape, known as the tie-back pouf, is formed by first mounting a C-shaped holder to opposing sides of a wall. A portion of the curtain material that extends down along the window is plaited to form a bar-like bundle and is pulled forward through the prongs of the holder from the wall area. The forwardly pulled portion of the curtain material is then pulled around the sides of the holder to form the tie-back pouf.

6 Claims, 4 Drawing Sheets

FIG. 1
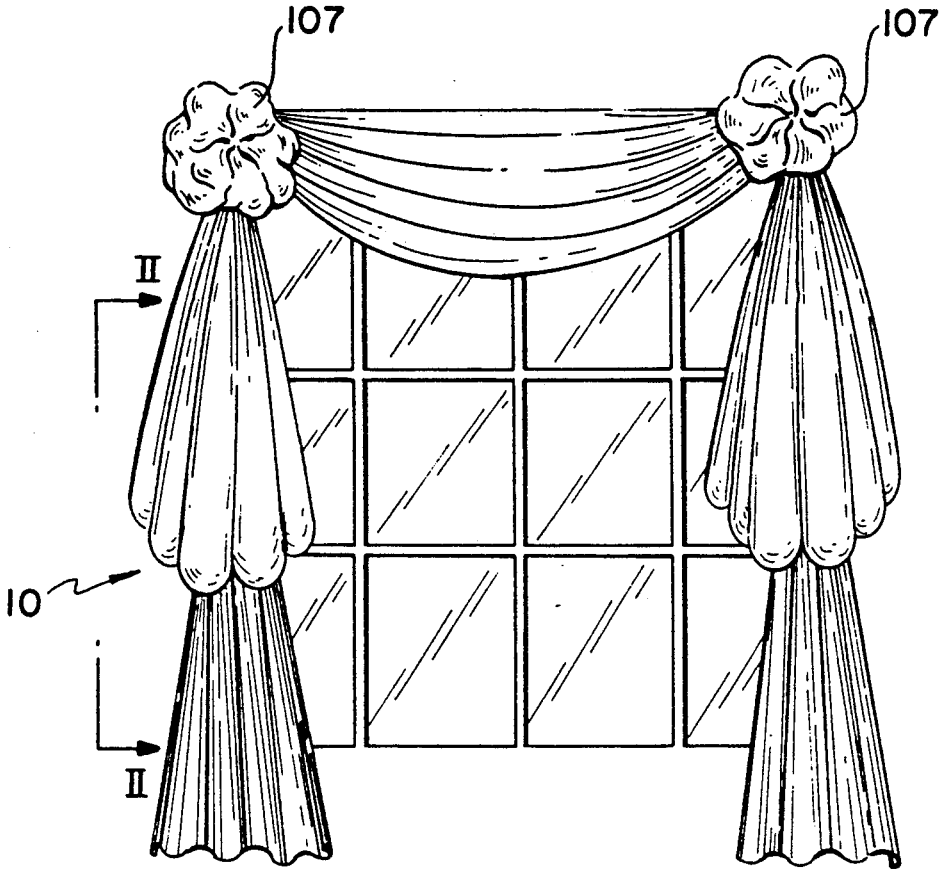
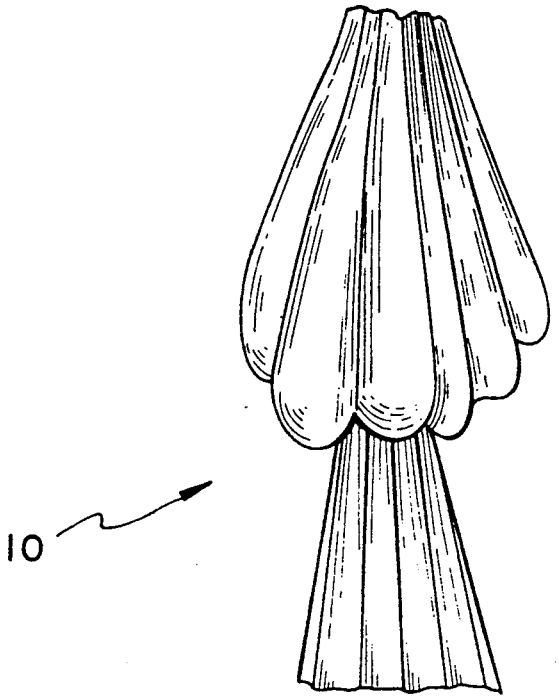
FIG. 2

METHOD FOR FORMING TIE-BACK POUFS

CROSS-REFERENCE TO RELATED APPLICATIONS

The present application is a continuation of U.S. Ser. No. 370,340, filed June 22, 1989, now U.S. Pat. No. 4,958,646, and continuation-in-part to U.S. Ser. No. 114,655, filed Oct. 28, 1987 (now abandoned), the teachings of both applications are hereby incorporated herein by reference.

BACKGROUND OF THE INVENTION

The present invention is directed to a method for draping curtains or the like. Generally a curtain material is supported over a window and the material will hang along the sides of the window. In one decorative arrangement, the curtain material is plaited or folded to form a bar-like bundle (zigzag or meander plaiting) and is placed over two supporting rods which are mounted in horizontally spaced relationship above the window or door. To form a draping arc between the two supporting rods, the lower portion of the curtain material is thereafter pulled down to form circular segment-type folds.

When the curtains are draped in such a manner, it is often desirable to enhance the appearance by forming a decorative shape, called a tie-back pouf, with the material that extends along each side wall. This requires a degree of skill to accomplish. In addition, it is often desirable to provide a means for retaining the curtain material at the sides of the window to prevent the drapes from covering too much of the window.

Accordingly, it is an object of the present invention to provide a method to form a tie-back pouf that does not require any special degree of skill and can be performed by one person.

It is still another object of the present invention to provide a kit assembly for forming a tie-back pouf that is so versatile that it may be used to support the curtain material.

SUMMARY OF THE INVENTION

These and other objects, as will be apparent to those skilled in the art, may be achieved from the practice of this invention.

The method described below makes it is extremely simple for even for an unskilled person to form the decorative shape, known as the tie-back pouf, with the curtain material that extends along the sides of a window when a curtain is hung. The holders used in the method are, in fact, ornamental holders and may be used to retain the curtain material in position.

The holders may be sold together with instructions which show how to form the tie-back pouf and various drapery arrangements that can include the tie-back pouf.

BRIEF DESCRIPTION OF THE DRAWINGS

Below, a preferred embodiment of the method of the invention will be explained in detail with reference to the accompanying drawings in which:

FIG. 1 shows, a fully draped window having tie-back poufs;

FIG. 2 shows the bishop sleeve;

DESCRIPTION OF THE PREFERRED EMBODIMENTS

Figure 11:
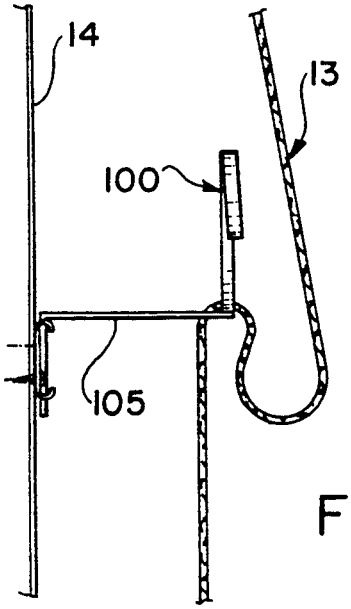
FIG. 11 is a section along the line II—II of FIG. 1 showing the tie-back pouf.

FIG. 1 shows a fully draped window having tie-back poufs 10 along the sides of the window. The tie-back poufs shown in FIG. 2 is formed using the holder 100 shown in FIG. 3. A cross section of the tie-back pouf 10 is shown in FIG. 11.

Figure 3:
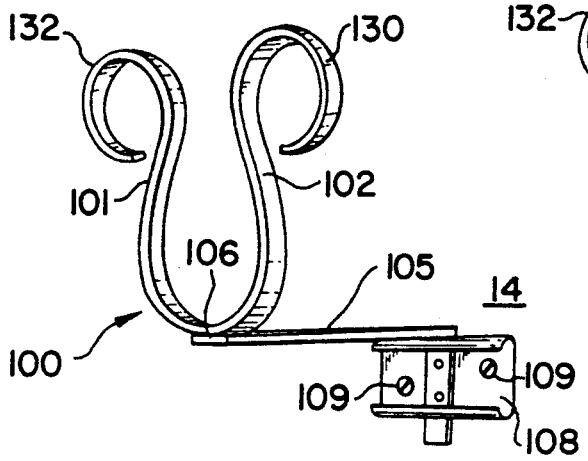
FIG. 3 is a perspective view of the holder of the present invention.
Figure 4:
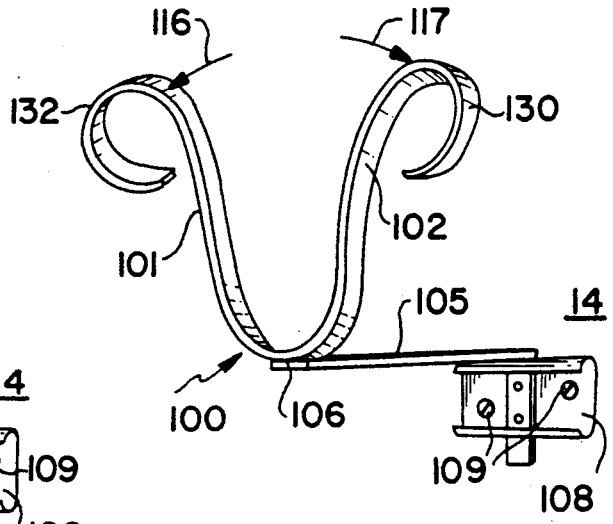
FIGS. 4–6 are perspective views illustrating the formation of the tie-back pouf.

FIG. 3 is a perspective view of the holder 100 that is used to form the tie-back pouf 10. The holder 100 is made from flat-bar material or the like and is bent to an approximate U- or C-shape. It has two prongs 101 and 102 which terminate in a curved surface portion 130 and 132 at an upper end thereof. The prongs may be resiliently spread apart as shown by arrows 116 and 117 in FIG. 4 to make it easier for the curtain material to be pulled through the holder. The C- or U-shaped member is affixed to a bar member 105 at the end 106 of the C-shape member that is opposite its opening. The holder is mounted in spaced relationship from a wall 14 via an L bracket 105 secured to the wall (mounting plate 108 and fastening screws 109 in FIG. 3) such that the plane defined by the two prongs 101, 102 of the holder extends approximately in parallel with the wall 14 or the surface thereof, respectively.

Figure 5:
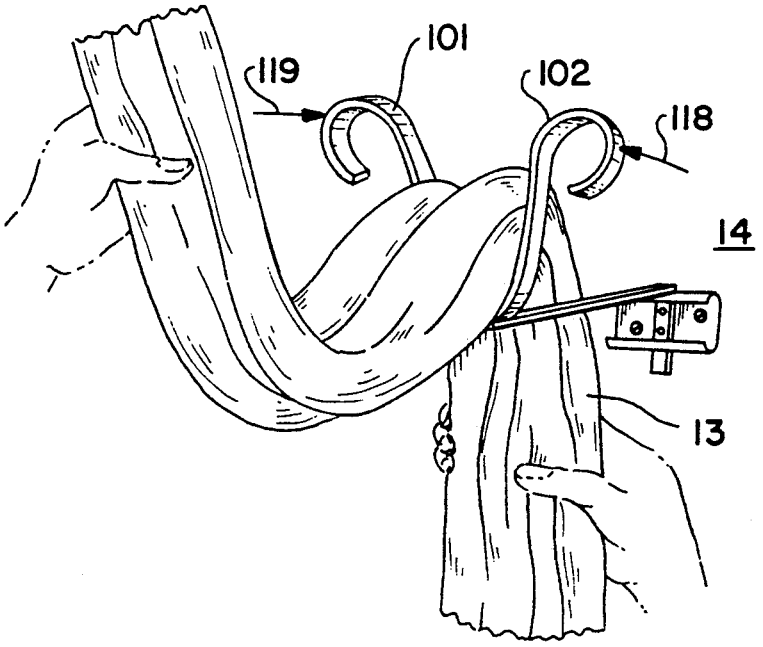

The tie-back pouf is formed by attaching the holder 100 to a wall 14 along the side of a window in the manner described above. A portion of curtain material 13 that extends along the window is plaited to form a bar-like bundle and then placed in the area between the holder and the wall. The bar-like bundle is then pulled forward through the prongs 101 and 102 of the holder approximately as far as shown in FIG. 5. Normally, this distance is about fifteen inches. To make it easier for the curtain material to be to be pulled through the prongs 101 and 102, the prongs 101 and 102 may first be spread apart as shown by arrows 116 and 117 in FIG. 4.

Figure 6:
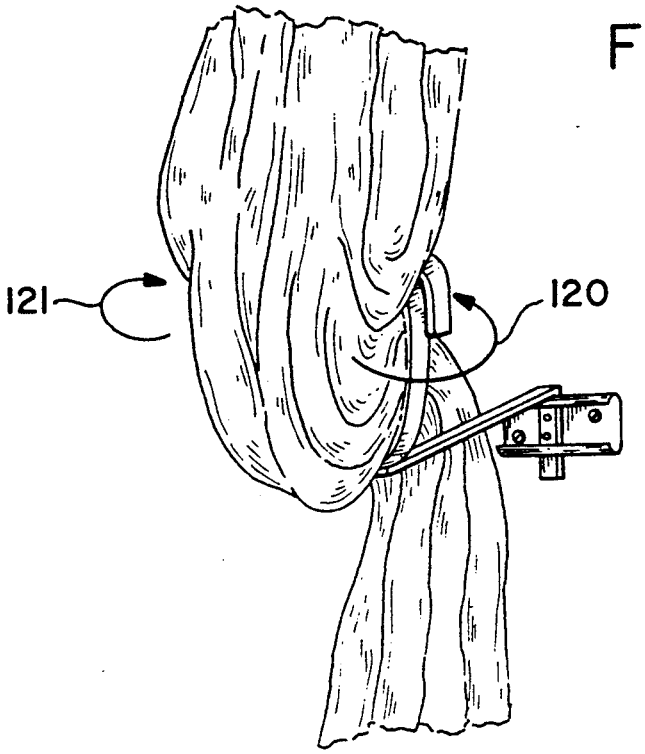

Once the material has been pulled through the prongs to the desired distance, the prongs 101 and 102 may be returned to their original position as indicated by arrows 118 and 119 in FIG. 5. With the prongs back to their original position, the curtain material is held securely in place. The portion of the curtain material 13 that has been pulled through the prongs I0l and 102 is then puffed out and spread around the prongs 101 and 102 as shown by the arrows 120 and 121 in FIG. 6 to conceal the prongs of the holder 100 and to form the desired tie-back pouf 10.

In one decorative arrangement, the holder 100 used to form the tie-back pouf 10 may also be used to hang the curtain material 13. When a curtain material is supported between two holders 100, it is possible to form a draping arc between the holders and a fabric rosette 107 as shown in FIGS. 7–10 in the vicinity of the holder 100. FIG. 1 shows a fully draped window having tie-back poufs 10, fabric rosettes 107 and a draping arc between the holders. When the holder described above is used to support the curtain material, it is extremely simple for even an unskilled person to form the draping arc, the fabric rosette and the tie-back pouf. Generally, it is very difficult for a single person to form the draping arc between two horizontally spaced holders and there is the possibility that the uppermost folds being pulled down while the draping arc is formed would sag between the two holders. The holder 100 eliminates the sagging of the upper most folds. Furthermore, the method does not require two or more persons, which is normally the case when draping a curtain or the like in accordance with the conventional technique, particularly when larger draping arcs or greater distances between the curtain holders are concerned.

In addition to forming the draping arc, the holder 100 permits the formation of fabric rosettes 107 at the supporting or holding locations of the curtain material. These holders 100 may be sold with instructions which show how to form the draping arc, the fabric rosettes 107 and the tie-back pouf 10.

Figure 7:
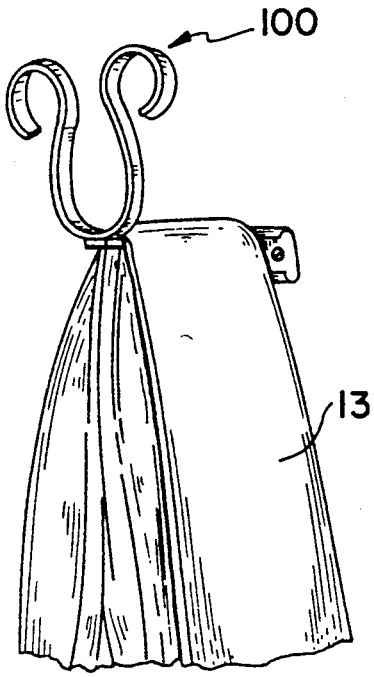
FIGS. 7–10 are perspective views illustrating the draping of a curtain by using a holder as shown in FIG. 3.
Figure 8:
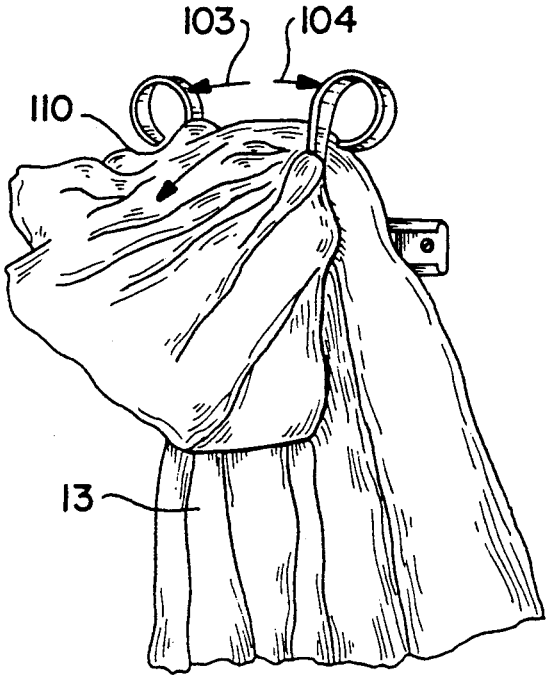
Figure 9:
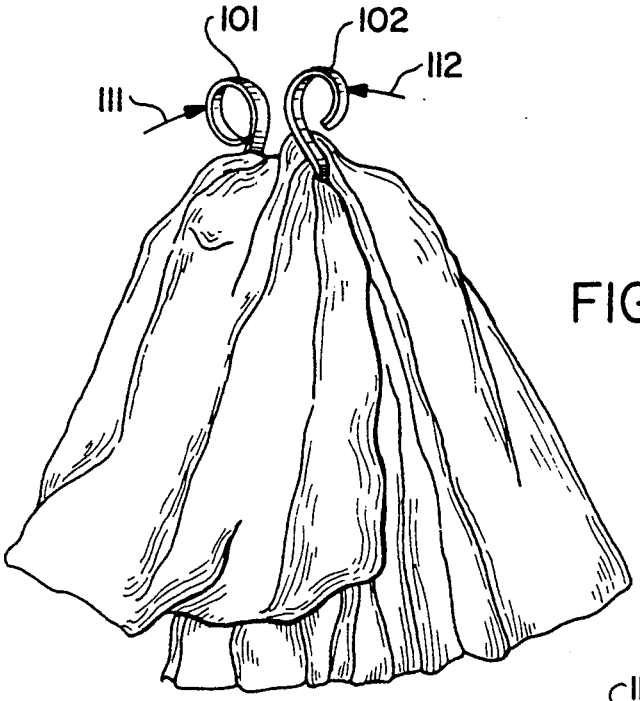
Figure 10:
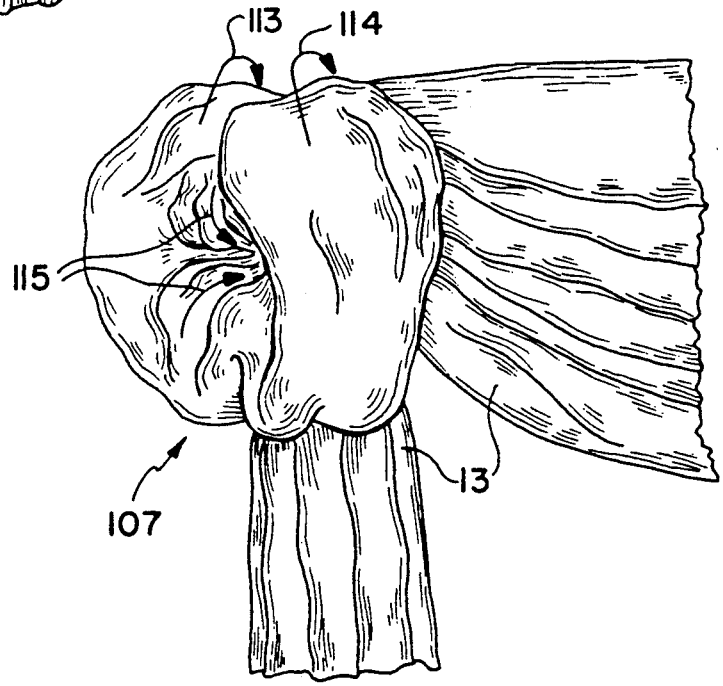

The decorative arrangement shown in FIG. 1 is formed by mounting four holders to an upright wall. Two holders are mounted above the window to support the curtain, and two holders are mounted on opposing sides of the window to form the tie-back pouf 10. The curtain material 13 is initially placed over the L bracket 105 of the holders above the window in meander-plaited configuration as illustrated in FIG. 7. An upper layer of curtain material is then pulled forward through the two prongs 101 and 102 as shown in FIG. 8 (see arroW 110 in FIG. 8), and during this operation the two prongs 101, 102 may be resiliently spread apart (see arrows 103, 104 in FIG. 8). The curtain material is pulled forward between the two prongs 101 and 102 approximately as far as shown in FIG. 9. When this step has been completed. the two prongs 101 and 102 can return to their initial positions as indicated by the arrows 111 and 112.

Thereafter, the forwardly pulled portion of the curtain material 13 is turned back over and between the prongs 101 and 102 (see arrows 113, 114, 115 in FIG. 10) to obtain the desired rosettes. This procedure is followed for both holders and the result is a draping arc between two fabric rosettes.

To form the tie-back pouf, the curtain material 13 that extends along the side wall is plaited to form a bar-like bundle and pulled through the prongs 101 and 102 of the holders on opposing sides of the Window as shown in FIG. 5. During this operation, the two prongs 101 and 102 may be resiliently spread apart (see arrows 116 and 117 in FIG. 4). When the curtain material 13 has been pulled through the two prongs 101 and 102 approximately as far as shown in FIG. 5 (approximately 15 inches) the two prongs 101 and 102 may be returned to their initial position as indicated by the arrows 118 and 119. Thereafter, the forwardly pulled portion of the curtain material is pulled around the prongs 101 and 102 as shown by the arrows 120 and 121 in FIG. 6 to form the tie-back pouf.

In another decorative arrangement, more than one tie-back pouf may be formed on each side of the window. This is accomplished by mounting two or more holders along each side wall of the window, one below the other. The tie-back pouf is formed in the manner described above. The remaining tie-back poufs are formed in a similar fashion using the curtain material that extends down beneath the first tie-back pouf.

It should be understood that using the method described above, tie-back poufs may be formed with virtually any hanging curtain material, rebardless of the manner in which the curtains are hung. For example, the U-shaped holder described in U.S. Ser. No. 370,340 may be used to hang the curtains. With the method described, it is extremely easy for anyone to form the tie-back poufs.

What is claimed is:

1. A method for draping a curtain forming material comprising the steps of:

a) attaching two holders to opposing sides of an opening in a wall, each holder having a C-shaped member positioned between and joining two prongs terminating in a curved surface portion at an upper end thereof, the C-shape member being affixed to a bar member at an end of the C-shaped member opposite its opening, said bar member having means to attach the holder to a wall;

b) supporting a curtain material above the holder such that the curtain material extends along opposing sides of the opening in the wall;

c) plaiting the portion of the curtain material that extends along the sides of the opening in the wall to form a bar-like bundle;

d) pulling a portion of the bar-like bundle forwardly from the wall through the prongs of each holder; and e) pulling a portion of the forwardly pulled material around the prongs of the holders to form a tie-back pouf.

2. The method for draping a curtain forming material of claim 1, and further comprising the step of providing more than one holder on opposing sides of an upright wall to form more than one tie-back pouf on each opposing side of the opening.

3. A method for draping a curtain forming material comprising the steps of:

a) attaching a first pair and a second pair of holders to opposing sides of an opening in a wall, with the first pair of holders positioned above the second pair of holders, each holder having a C-shaped member positioned between and joining two prongs terminating in a curved surface portion at an upper end thereof, the C-shaped member being affixed to a bar member at an end of the C-shaped member opposite its opening, said bar member means to attach the holder to a wall;

b) placing a lengthwise folded curtain forming material defining a plurality of layers thereof on each bar member of the first pair of holders;

c) pulling an upper layer of said lengthwise folded curtain forming material forwardly through said two prongs of each holder in the first pair of holders;

d) pulling said upper layer of said curtain forming material rearwardly and upwardly over said curved surface portions of each holder in said first pair of holders to form two fabric rosettes, and a draping arc between the fabric rosettes;

e) plaiting a portion of the curtain material that extends below the fabric rosettes to form a bar-like bundle;

f) pulling a portion of the bar-like bundle forwardly away from the wall through the prongs of each holder in the second pair of holders; and g) puling a portion of the forwardly pulled curtain material around the prongs to form a tie-back pouf.

4. A method for draping a curtain-forming material comprising the steps of:

a) attaching two holders to opposing sides of an opening in a wall, each holder including a bar member having a first end and a second end, a first prong and a second prong projecting upwardly from adjacent said first end of said bar member and forming a space between said first and second prongs and means for attaching the bar member to said wall beinb provided adjacent to said second end of said bar member;

b) supporting a curtain material above the holder such that the curtain material extends along opposing sides of the opening in the wall;

c) plaiting the portion of the curtain material that extends along the sides of the opening in the wall to form a bar-like bundle;

d) pulling a portion of the bar-like bundle forwardly from the wall through the prongs of each holder; and e) pulling a portion of the forwardly pulled material around the prongs of the holder to form a tie-back pouf.

5. The method of draping a curtain forming material of claim 4, and further comprising the step of providing more than one holder on opposing sides of said opening in a wall to form more than one tie-back pouf on each opposing side of the opening.

6. A method for draping a curtain forming material comprising the steps of:

a) attaching a first pair and a second pair of holders to opposing sides of an opening in a wall, with the first pair of holders positioned above the second pair of holders, each holder including a bar member having a first end and a second end, a first prong and a second prong projecting upwardly from adjacent said first end of said bar member and forming a space between said first and second prongs and means for attaching the bar member to said wall being provided adjcent to said second end of said bar member;

b) placing a lengthwise folded curtain forming material defining a plurality of layers thereof on each bar member of the first pair of holders;

c) pulling an upper layer of said lengthwise folded curtain forming material forwardly through said two prongs of each holder in the first pair of holders;

d) pulling said upper layer of said curtain forming material rearwardly and upwardly over said two prongs of each holder in said first pair of holders to form two fabric rosettes, and a draping arc between the fabric rosettes;

e) plaiting a portion of the curtain material that extends below the fabric rosettes to form a bar-like bundle;

f) pulling a portion of the bar-like bundle forwardly away from the wall through the prongs of each holder in the second pair of holders; and g) pulling a portion of the forwardly pulled curtain material around the prongs to form a tie-back pouf.

* * * * *